United States Patent [19]

Wyss et al.

[11] Patent Number: 4,469,530

[45] Date of Patent: Sep. 4, 1984

[54] METHOD FOR REDUCING THE HARDENING DISTORTION DURING CASE HARDENING OF LARGE TOOTHED RIMS FORMED OF STEEL AND SUPPORT BODY MEMBERS SUITABLE FOR SUCH PURPOSE

[75] Inventors: Urs Wyss; Johannes Federer, both of Zürich, Switzerland

[73] Assignee: Maag Gear-Wheel & Machine Company Limited, Zürich, Switzerland

[21] Appl. No.: 387,327

[22] Filed: Jun. 11, 1982

[30] Foreign Application Priority Data

Jun. 19, 1981 [CH] Switzerland ..... 4063/81

[51] Int. Cl.[3] ..... C21D 9/32

[52] U.S. Cl. ..... 148/16.5; 148/3; 148/131; 29/159.2

[58] Field of Search ..... 148/16.5, 131, 3; 29/159.2

[56] References Cited

U.S. PATENT DOCUMENTS

| | | | |
|---|---|---|---|
| 1,561,041 | 11/1925 | White | 29/159.2 |
| 4,154,628 | 5/1979 | Dudek | 148/16.5 |
| 4,179,313 | 12/1979 | Koch et al. | 148/3 |
| 4,376,662 | 3/1983 | Brimm | 148/131 |

FOREIGN PATENT DOCUMENTS

| | | | |
|---|---|---|---|
| 558616 | 6/1958 | Canada | 148/16.5 |
| 2652386 | 7/1978 | Fed. Rep. of Germany . | |

*Primary Examiner*—Veronica O'Keefe
*Attorney, Agent, or Firm*—Werner W. Kleeman

[57] ABSTRACT

To reduce the hardening distortion during the case hardening of large toothed rims or gear wheels formed of steel the toothed rim or the like during cooling thereof, starting from the hardening temperature, is shrunk during the $\gamma/\alpha$ transformation of its core material upon a support body member, and then there is limited, during the further cooling to room temperature, the increase of the stresses in the toothed rim in that the support body member is inserted into the toothed rim in a pre-heated condition. The material of the support body member has a greater coefficient of thermal expansion than that of the toothed rim.

6 Claims, 8 Drawing Figures

METHOD FOR REDUCING THE HARDENING DISTORTION DURING CASE HARDENING OF LARGE TOOTHED RIMS FORMED OF STEEL AND SUPPORT BODY MEMBERS SUITABLE FOR SUCH PURPOSE

BACKGROUND OF THE INVENTION

The present invention relates to a new and improved method of reducing the hardening distortion during the case hardening of large toothed gear rims or the like formed of steel, and further pertains to a novel support body member suitable for the practice of the inventive method.

By case hardening the teeth of toothed gear rims or ring gears or the like it is possible to appreciably increase the load limits—such as flank strength and tooth root or base strength—of gears and toothed rims. It is already known in this technology that, during case hardening of even smaller gears there arises a distortion on hardening, and that this distortion, with increasing size of the gears, causes even appreciably greater difficulties, since with increasing gear size the dimensional and shape changes progressively exceed the permissible tolerances. These dimensional and shape changes significantly increase the time which is needed for the subsequent grinding of the gear teeth. Therefore, it is desirable to maintain the hardening distortion, i.e. the dimensional and shape changes, associated with case hardening of particularly large toothed gear rims, within as narrow limits as possible.

When processing larger gears case hardened toothed gear rims are generally connected by means of wheel disks or webs formed of metal plating or sheet metal with their hubs or shafts, respectively; It is known from German Patent Publication No. 2,606,245, published Aug. 18, 1977, to weld the toothed rim formed of case hardened steel with the wheel disk, and to then weld such to the shaft or hub. The toothed or gear rim is subsequently provided with teeth and thereafter carburized and hardened. Already during carburization there can arise dimensional and shape changes to such a degree that the teeth must be post-machined prior to hardening. However, there thus are present at the gear teeth irregularities in the carburization or case hardening depth. During hardening there occur further shape and dimensional changes.

Additionally, by virtue of the different behavior in the dimensional changes of the differently welded components, namely the weld rim, webs formed of metal plating, and hubs for instance, there arise unpredictable internal stress conditions which, in conjunction with the welding seams, constitute a difficult to detect or control uncertainty or irregularity.

Therefore, it is preferable to carburize and harden as such the toothed or gear rim formed of case hardenable steel, and to only thereafter join such part together with a wheel disk or webs formed of metal plating or sheet metal.

During the carburization and subsequent hardening of a separate toothed or gear rim of appreciable size and having the usually modest wall thickness, there occur, however, large dimensional changes and distortions which, particularly in the case of small modules, render questionable the use of the toothed or gear rim following its thermal treatment.

SUMMARY OF THE INVENTION

Therefore, it is a primary object of the present invention to avoid the aforementioned drawbacks and shortcomings of the prior art proposals.

Another and more specific object of the present invention aims at providing a novel method of counteracting the distortions arising during hardening, in other words in particular the dimensional and shape or configuration changes which occur during the case hardening of large toothed or gear rims.

Still a further significant object of the present invention aims at devising a new and improved method for the reduction of the hardening distortion arising during the case hardening of large toothed or gear rims or the like formed of steel, while providing a hardening method which is nonetheless relatively simple and economical to perform.

Yet a further important object of the present invention is directed to a novel construction of support body member which can be advantageously used in the practice of the method aspects of the invention.

Now in order to implement these and still further objects of the invention, which will become more readily apparent as the description proceeds, the method aspects of the present development are manifested by the features that, the toothed or gear rim or the like during cooling, starting from the hardening temperature, is permitted to shrink during the $\gamma/\alpha$-transformation of its core material upon a support body member, and during further cooling to room temperature there is limited the increase of the stresses in the toothed rim.

With the inventive method there is exploited, during the shrinking operation, the increased plasticity of the steel which is in the process of undergoing transformation, in order to thus impart to the toothed or gear rim a relatively faultless roundness or concentricity and cylindricalness.

Generally, it can be stated that with conventional alloyed case hardened steels, as such are intended to be used for highly loaded and larger transmission gears, the transformation temperature of the core material—also dependent upon the quenching agent—is in the order of between 550° C. and 300° C.

Certain of the more important considerations or aspects as concerns the inventive method and the apparatus suitable for the performance thereof can be enumerated as follows:

(a) During the shrinking process there occurs a plastic deformation, while the core material of the carburized toothed or gear rim is still in a state of transformation; and (b) The shrinkage stresses within the toothed or gear rim, during progression of the cooling, are limited to a such a value that there does not arise any damage.

From both of these requirements there are derived two variants of the method, namely:

(A) The carburized toothed or gear rim is quenched from the hardening temperature, for instance 850° C., where the steel of the toothed rim is in its austenitic condition, together with a disc-like support body member which has been pre-heated to a predetermined temperature, for instance 400° C.; and (B) There is inserted into the carburized toothed or gear rim which is at the hardening temperature, where the steel of the toothed rim is in its austenitic condition, a cold disc-like support body member, and during the progressive cooling of the toothed or gear rim there occurs the shrinking thereof upon the disc-like support body member, wherein, by means of a deformable part or components there is precluded a too great increase of the shrinkage stresses within the toothed or gear rim.

Based upon both of these method variants there are also predicated the different constructions of the support body member needed for the performance of the inventive method.

Since in the state of transformation of the non-carburized core material of the toothed or gear rim the latter possesses a high plasticity, there are only needed modest deformation forces in order to permanently counteract the non-roundness or non-trueness and conicity. If there is viewed the cross-sectional area of a toothed or gear rim following carburization, then it will be seen that only a relatively thin carburized marginal zone surrounds a non-carburized core which constitutes the geatest part of the cross-sectional area. It is well known that the transformation of the non-carburized core material occurs at a higher temperature than that of the carburized marginal layer. During the plastic deformation, in order to eliminate the non-roundness and conicity according to the inventive method, the marginal region participates in the dimensional change without any difficulties. A particularly advantageous temperature for such plastic deformation, depending upon the treated material, is in the order of between about 450° C. and 300° C.

As explained, the deformation force exerted by the support body member upon the toothed or gear rim, during the progressive cooling, should not ascend or increase to such an extent that there can arise within the toothed or gear rim dangerous stresses, and there is practically no longer possible a removal of the support body member out of the cooled toothed or gear rim without damaging the same. This must be taken into account during the design of the support body member which is employed during the practice of the inventive method. Hence, attempts therefore should be made to preclude a further increase in the shrinkage stresses within the toothed or gear rim at temperatures beneath 250° C. to 300° C.

These requirements correspond to the aforementioned method variants (A) and (B) disclosed heretofore. During the method variant (A), by appropriate selection of the material, the pre-heating temperature and the insulation of the support body member, it is possible to coordinate its shrinkage behavior such that the toothed or gear rim, during the transformation of its core material, shrinks onto the support body member, and during the further cooling there is prevented any too great increase of the shrinkage stresses in the toothed or gear rim. With the method variant (B), after a certain amount of the shrinkage of the toothed or gear rim at the region of a predetermined shrinkage stress, due to plastic deformation of the pressure-absorbing and thus deformable elements arranged at the circumference of the support disk of the support body member, such as pieces of pipes or profiles of random shape or cross-section or a thin-walled cylindrical intermediate part in the case of multi-part support body members, there is lost its force which has been brought into play. By virtue of such plastic deformation of the pressure-absorbing elements or pressure-take-up there is not built-up any excessive shrinkage stress in the toothed or gear rim.

With an apparatus for the performance of the inventive method according to the variant (A), predicated upon a transformation temperature of the core material of the toothed or gear rim of, for instance, 450° C. to 300° C., at which there also should proceed the shrinkage phenomenon, the outer diameter of the support body member must be approximately 5 to 6% greater than the inner diameter of the toothed gear or rim in its cold condition. Consequently, there must be contemplated a plastic enlargement of the toothed rim-inner diameter by about 1.5%. Without the inventive use of a correspondingly constructed support body member possessing an appropriate temperature, the toothed rim until cooling down to room temperature would shrink by 3 to 4.5%; This shrinkage of the toothed or gear rim would result in freezing or binding thereof upon the support body member, so that such could not be removed without damaging the same, and moreover, the toothed gear or rim would be loaded by excessive shrinkage stresses to a point where it would become damaged.

The support body member which is to be used in accordance with the teachings of the invention, advantageously is constituted by a solid support disk possessing radial webs or strut members arranged at its circumference, or may be constituted by a support disk possessing multi-part radially displaceable segments. The support disk or support disk member is insulated at its end and cylindrical surfaces in order to delay the withdrawal of heat. This insulation is constituted, for instance, by a threadably connectable cover formed of sheet metal or metal plating and possessing an intermediate layer formed of asbestos.

The temperature to which there should be heated the support body member can be maintained relatively low if it is formed of an austenitic steel. Such austenitic steel, as is well known, possesses an appreciably greater coefficient of thermal expansion than ferritic steel from which, for instance, there is fabricated the toothed or gear rim. By virtue of the larger coefficient of thermal expansion of the material of the support body member there occurs a more rapid reduction in the diameter, so that there is reduced the danger of any excessive build-up of shrinkage stresses in the toothed or gear rim. By virtue of such type of support body member there is ensured that the toothed or gear rim will shrink thereon in a temperature range of about 450° C. to 300° C. and will be faultlessly pressed round or circular, since during the $\gamma/\alpha$-transformation of the core, at the region of higher plasticity, it will snugly bear against the support body member.

Once the transformation of the core of the hardened toothed or gear rim has terminated, then the shrinkage stress is continuously reduced, since by virtue of the withdrawal of heat the outer diameter of the support body member continuously decreases. Once the toothed or gear rim and the support body member have cooled to room or ambient temperature then the support body member can be easily removed from the toothed or gear rim, since by virtue of its plastic enlargement, on the one hand, and the thermal post-shrinkage of the support body member, on the other hand, there is formed clearance or play between both of these parts.

With the above-discussed embodiment of support body member in the form of a support disk containing webs or strut members there is present a particular advantage by virtue of the fact that, during quenching in the hardening bath the hardening oil at least comes into contact with one part of the inner surface of the toothed or gear rim, and thus, not only cools such at three surfaces, but also at its inner surface.

A further advantage of this construction of the support body member resides in the fact that, the webs or the like can be accommodated without any great difficulty to the momentarily required dimension of the support body member. Thus, for instance, such can be exchanged for appropriately dimensioned webs or equivalent structure. It is possible to reduce in size existing support body members by shortening the webs or increasing the size of existing support body members by interposing strips or the like formed of metal plating or sheet metal or the like. This is of special significance in consideration of the fact that, in particular, in the cae of large size toothed or gear rims a certain number will not have the same shape and dimensional changes of each piece. Thus, by slightly varying the effective outer or external diameter of the support body member it is possible to harden an entire series of the same size toothed or gear rims, without for this purpose needing considerable investments or considerable equipment expenditure through the need to separately fabricate the support body member for each toothed or gear rim.

During the hardening of toothed or gear rims having an internal or inner diameter greater than about 1700 mm, experience has shown that the dimensional change during carburization and again heating-up to the hardening temperature, under circumstances, is greater than the plate or clearance between the inner circumference of the toothed or gear rim at the hardening temperature and the outer circumference of the pre-heated support body member. The previously described construction of support body member then can be modified for such situation in that, instead of the fixedly mounted webs there can be provided four to six movable, especially slidably mounted segments. Prior to assembly of the hot toothed or gear rim upon the support body member the segments are appropriately displaced together, and then in known manner brought hydraulically or mechanically into a fixed impact position against the toothed or gear rim. Now it is possible to quench the toothed or gear rim together with the support body member in the manner previously described.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
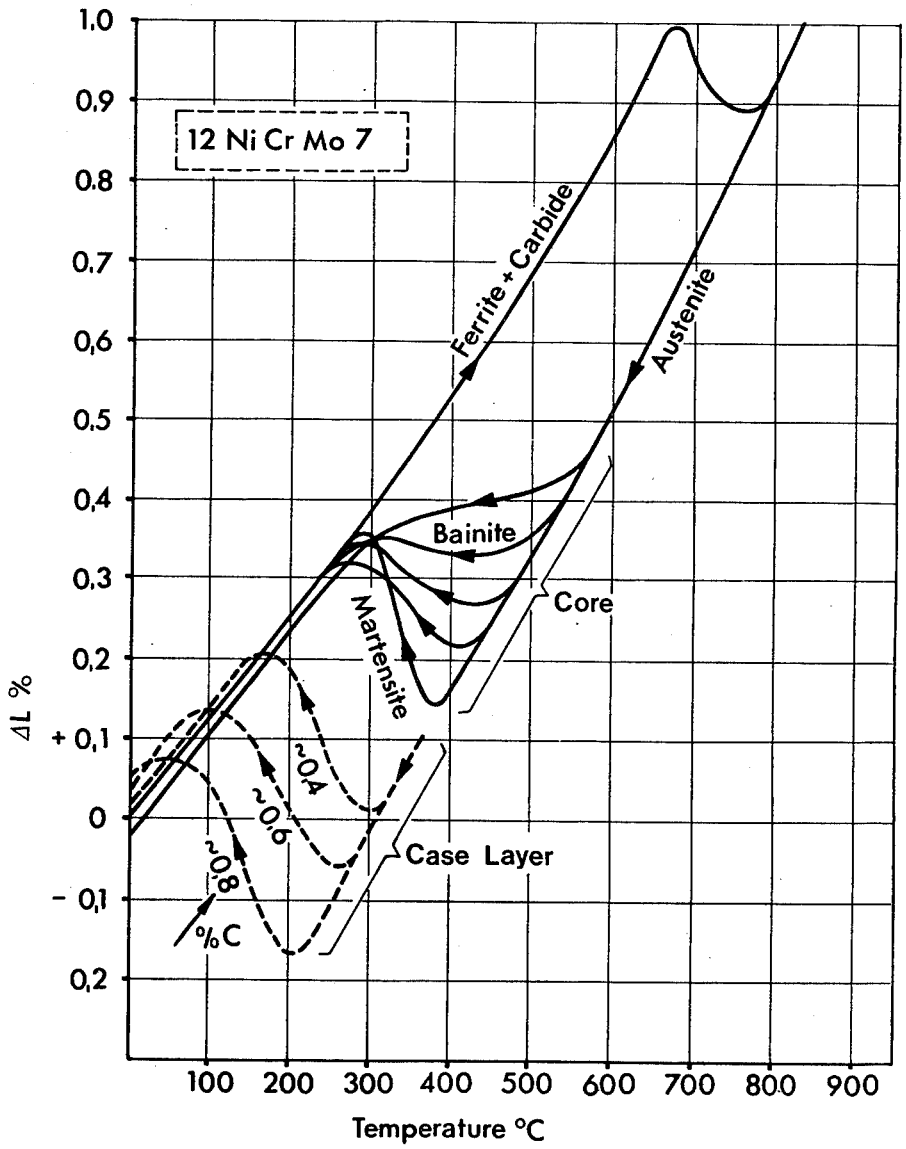
FIG. 1 illustrates a dilatometer curve diagram.

Describing now the drawings, in FIG. 1 there has been illustrated a diagram in the form of dilatometer curves. On the one hand, there has been plotted at such curves the $\gamma/\alpha$ transformation during slow heating and, on the other hand, the $\gamma/\alpha$-transformation during rapid cooling—for instance quenching in oil—of a case hardened steel 12NiCrMo7, which indicate the length changes $\Delta L$ as a function of the temperature.

Figure 3:
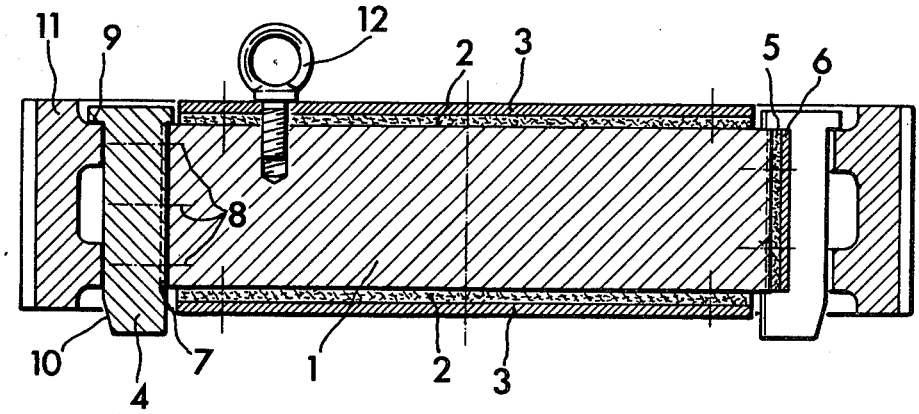
FIG. 3 is a cross-sectional view of the arrangement of FIG. 2, taken substantially along the section line III—III thereof.
Figure 2:
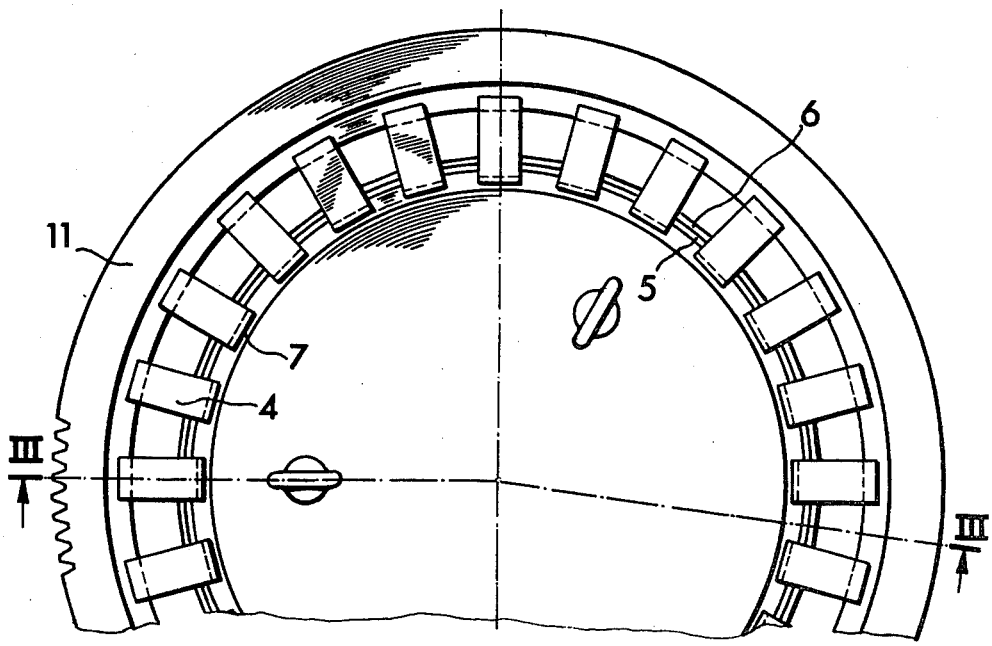
FIG. 2 is a top plan view of a toothed or gear rim provided with a one-part support body member.

FIGS. 2 and 3 illustrate a disc-like support body member or support body containing a solid disk or plate 1 formed of austenitic material. The width of the support body member corresponds approximately to the width of the toothed or gear rim—hereinafter usually briefly simply termed toothed rim—which is to be hardened. Both sides or faces of the solid disk or plate 1 are insulated by means of an asbestos layer 2 of approximately 5 mm thickness. These asbestos layers 2 are secured to the disk or plate 1, for instance by means of threadably connectable steel plate members 3. At the circumference of the disk or plate 1 there are arranged a large number of webs or strut-like members 4 or equivalent structure. The circumferential surface 5 of the disk or plate 1 which remains free between the webs 4 is likewise covered with asbestos and the asbestos insulation is secured by means of threadably connectable steel strips 6. The webs 4, which need not be formed of austenitic material, are secured in guide grooves 7 at the disk or plate 1 with the aid of threaded bolts 8 or equivalent fastening expedients. In order to provide a slight enlargement of the diameter of the support body member there can be inserted into the guide grooves 7 strips formed of metal plating or sheet metal. However, if there is required for a larger toothed or gear rim a more pronounced enlargement of the diameter of the support body member then the webs or web members 4 are replaced by web members of a greater width.

The web members 4 possess shoulders 9 which come to bear upon correspondingly formed inner surfaces of the toothed or gear rim 11, and thus, appropriately fix in desired position the support body member within the toothed rim 11. In order to facilitate the insertion of the support body member into the toothed rim 11 the web members 4 are each provided with a bevelled portion 10 at the region opposite the shoulder 9 thereof.

The support body member is provided with a plurality, here three ring screws or threaded bolts 12 or equivalent structure which are conveniently employed for raising the support body member with the aid of any suitable hoisting device, typically a crane. The toothed rim 11 with the inserted support body member is subsequently removed, by means of a not particularly illustrated suspension device, from the furnace car or dolly and lowered into the cooling bath.

In order to harden tooth or gear rims having an internal or inner diameter starting with approximately about 1700 mm there is employed a multi-part support body member. Of course, there also can be used for smaller toothed or gear rims multi-part support body members;

however, for constructional and economical reasons it is preferred to work as much as possible with one-part support body members.

Figure 4:
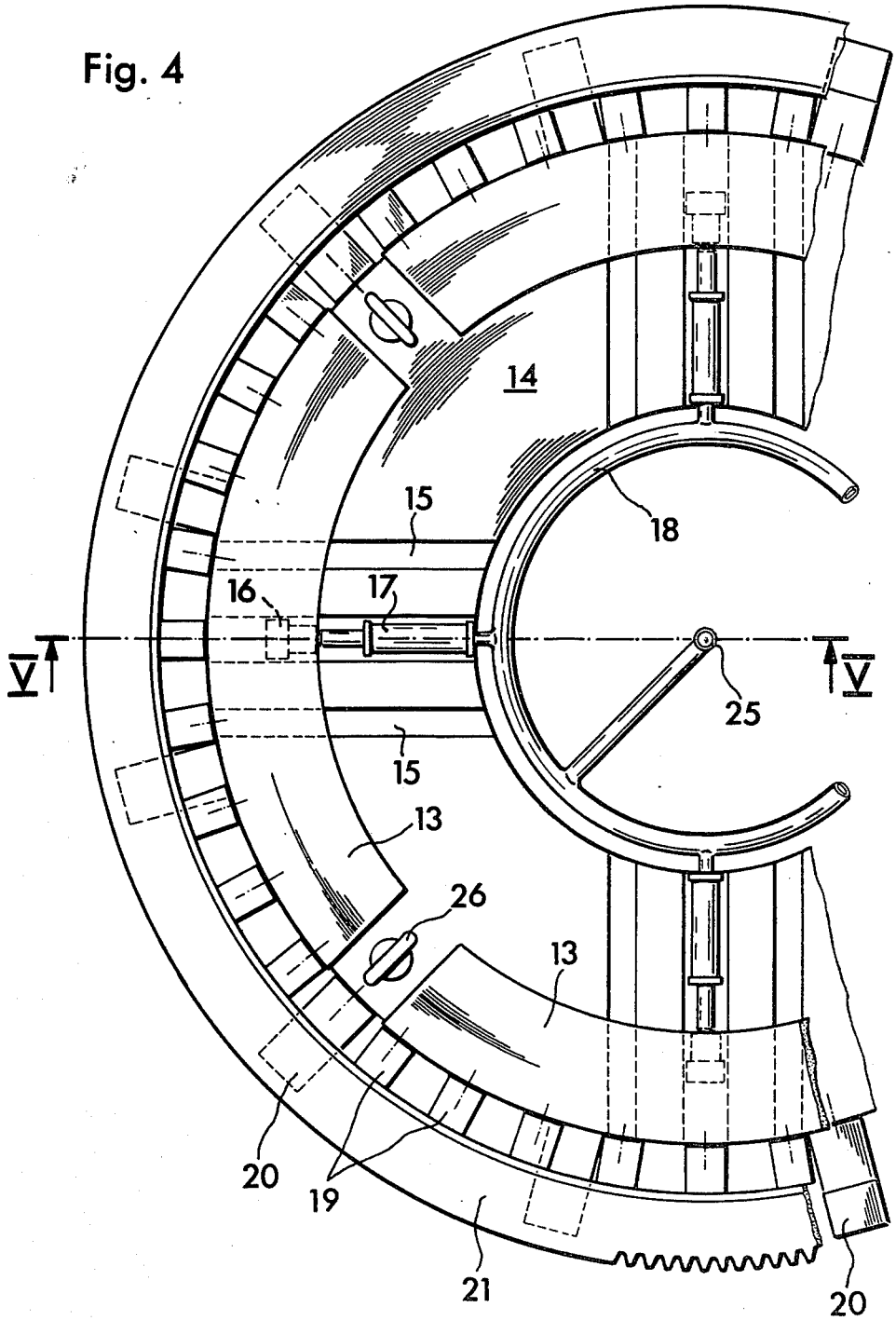
FIG. 4 is a fragmentary top plan view of a multi-part support body member which has been inserted into a toothed or gear rim.

FIG. 4 illustrates a support body member formed of four segments or segment members 13 which are arranged in a toothed or gear rim, these segments 13 being displaceable upon a steel plate 14 radially in guide grooves 15 up to an adjustable stop or impact member 16. The displacement of the segments 13, in the illustrated exemplary embodiment of the inventive support body member, is accomplished by means of pistons i.e. piston-and-cylinder units 17 which can be hydraulically actuated by means of a ring line or conduit 18, this ring line or conduit 18 having infed thereto a suitable working medium from a not particularly illustrated but conventional supply source.

At the circumferential surface of the segments 13 there are bolted or otherwise appropriately threadably connected web members 19 and support members 20 at the steel plate 14. Bearing upon the support members 20 is the toothed or gear rim 21.

During performance of the inventive method with the aid of the support body member depicted in FIG. 4, the cooling medium arrives between the support members 20 and the web members 19 at a portion of the inner surface of the toothed or gear rim 21, so that the cooling or cooled surface of the toothed rim is enlarged.

The disk or plate body 22 consists of an austenitic material and is pre-heated, just as was the case for the embodiment depicted with reference to FIGS. 2 and 3. The upper and lower surfaces of the disk body 22 are here also insulated by means of asbestos inserts 23 and such fixedly bolted or threadably connected with the steel plates 24.

In order to perform the inventive method the four segments 13 are radially inwardly drawn and with the aid of a suitable lifting or hoisting device the carburized toothed or gear rim 21 is moved over the support body member and lowered onto the support members or supports 20. Even with large distortion of the toothed or gear rim there is afforded sufficient play between the web members 19 and the inner circumference of the toothed or gear rim 21. Now these segments 13 are displaced hydraulically radially towards the outside with the aid of the pistons 17 or the like against the stop or impact members 16 and into a predetermined position. Thereafter, the pre-heated disk or plate bodies 22 are inserted between the segments 13. After releasing the plug screw connection 25 for the hydraulic medium for actuating the pistons 17 the entire unit is raised at the ring screws or bolts 26 and transported into the oil vat.

Figure 5:
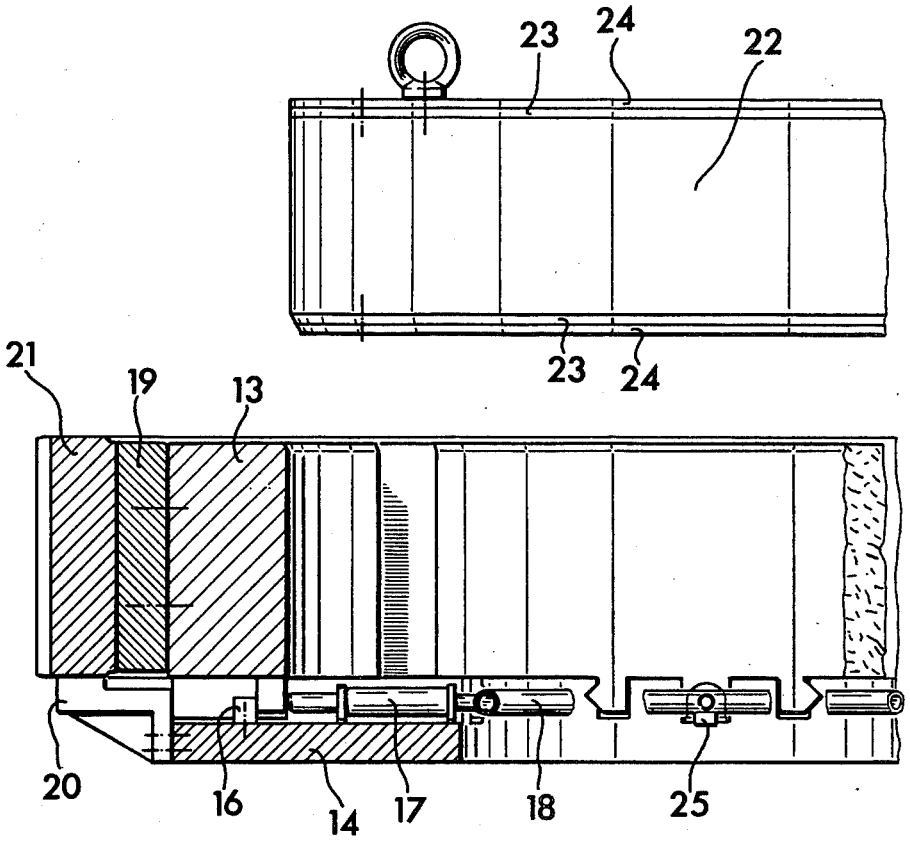
FIG. 5 is a cross-sectional view of the arrangement of FIG. 4, taken substantially along the section line V—V thereof.

A modification of the disc-like support body member according to FIGS. 4 and 5 resides in the feature that, there is inserted, instead of the support disk or plate 22, a thin-walled, substantially cylindrical-shaped intermediate or central part which is not pre-heated. The wall thickness and the strength of the cylinder are designed such that upon exceeding a predetermined shrinkage stress in the toothed rim it is plastically deformed during cooling down to room or ambient temperature. The outer diameter of this embodiment of inventive support body member is dimensioned such that the toothed or gear rim can shrink-on during its structural transformation of the core material. After cooling down to room temperature the central part is removed by machining or in pieces with the aid of a cutting torch out of the segments. With this embodiment of the inventive support body member it is necessary to fabricate for each toothed rim its own central part and such then can again be removed while being broken apart or destroyed after completion of the hardening operation, but, on the other hand, however, it is not necessary to pre-heat the support body member, and the central or intermediate part constitutes a component which can be simply and inexpensively manufactured.

Figure 6:
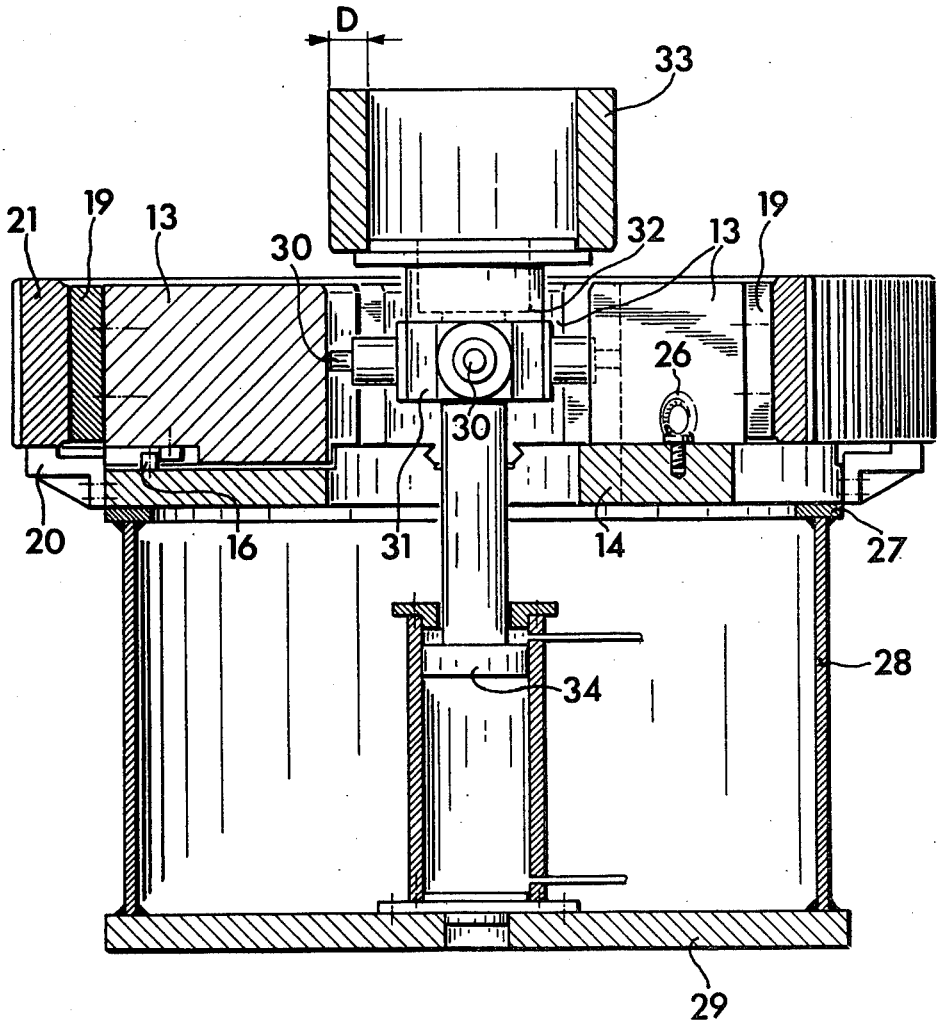
FIG. 6 is an axial sectional view of the support body member inserted into a toothed or gear rim according to a different embodiment of the invention.

A further modification of the disc-like support body member depicted in FIGS. 4 and 5 and constructed according to the teachings of the present invention has been illustrated in FIG. 6. The steel plate 14 bears upon a substructure or support arrangement composed of the parts 27, 28 and 29. The toothed or gear rim 21 is deposited upon the supports 20 of the segments 13, whereafter the segments 13 are displaced with the aid of hydraulically actuated pistons 30 or equivalent structure towards the predetermined stops or impact members 16. After pressure relief the piston support or carrier 31 together with the central or intermediate part 33 mounted upon the centering element 32 is lowered by means of a further hydraulically actuated piston or piston-and-cylinder unit 34, until the central part 33 bears upon the steel plate 14. Now the steel plate 14 can be raised or lifted from the substructure 27, 28 and 29 at the four ring screws 26 or the like and horizontally lowered into the cooling bath.

According to an additional design of the invention, the disc-like support body member of FIGS. 2 and 3 can be further modified in a manner such that, instead of the radial webs 4, there are attached to the support disk or plate 1 pressure-absorbing or pressure-take-up, and thus, deforming elements, such as pieces of pipes or profiles or sections of random shape or cross-sectional configuration. The outer diameter of the support body member is dimensioned such that the toothed or gear rim, during the transformation of its core material, is shrunk onto the support body member. The cross-section of the elements is dimensioned such that it is plastically deformed during the further shrinkage of the toothed rim following the core transformation, before the material of the toothed rim experiences a damaging load or stress.

After cooling down to room or ambient temperature the deformed elements are appropriately removed, for instance by a cutting torch, so that the toothed rim can be raised.

For each toothed rim which is to be hardened it is necessay to fabricate new elements; however with this embodiment there is dispensed with the need of insulating the sides or faces of the disk and the pre-heating of the support body member to a predetermined temperature.

Figure 8:
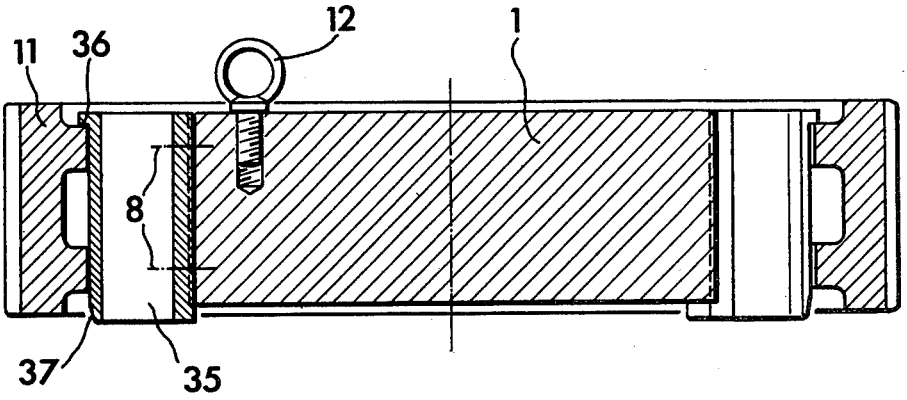
FIG. 8 is a cross-sectional view of the arrangement of FIG. 7, taken substantially along the sectional line VIII—VIII thereof.
Figure 7:
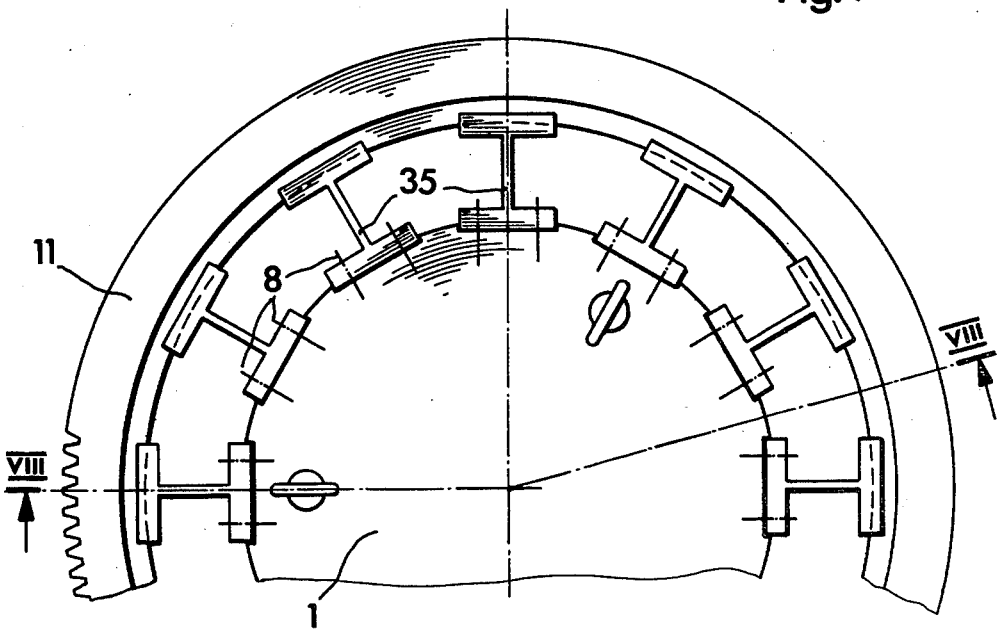
FIG. 7 is a top plan view of a toothed or gear rim having a one-part support body member according to another embodiment of the invention.

FIGS. 7 and 8 constitute a thus constructed embodiment of support body member. At the circumference of the disk or plate 1 there are attached by means of threaded bolts or screws 8 or equivalent fastening expedients a plurality of deformable elements 35, here possessing a double-T-shaped configuration. The support body member is inserted at the ring screws 12 into the hot toothed rim or ring gear 11 until it bears against the shoulders 36 of the elements 35 at the toothed rim 11. To facilitate insertion the elements 35 are provided opposite the shoulders 36 with a respective bevelled or inclined portion 37. The toothed rim 11 together with the inserted support body member is thereafter lifted by a not particularly illustrated but conventional suspension or hoisting device and then lowered into the cooling bath.

The invention now will be further explained based upon the following example.

EXAMPLE

There is to be case hardened a toothed rim having helical teeth and possessing the following dimensions:

Outer diameter 1718.9±0.15 mm
Tooth width 400 mm
Module 9.75
Tooth helix angle 6°
Web-inner diameter 1470 mm.

For carburizing and hardening there is prepared a toothed rim having the following dimensions:

Outer diameter 1718 mm, tooth width 401 mm, and web-inner diameter 1430 mm. The teeth are cut while adding a grinding allowance.

The carburizing took place in a pit type furnace containing a regulated or controlled atmosphere, and the toothed rim was mounted upon a solid charging frame having a vertical axis. The carburization temperature amounted to 900° C. The inner circumference of the toothed rim was protected in conventional manner, in order to prevent any carburization. After the carburization the toothed rim together with the charging frame or framework was moved out of the shaft furnace and cooled in draft-free air down to about 650° C., subsequently maintained in a further pit furnace for ten hours at 600° C., and thereafter cooled down to room or ambient temperature.

Measurements carried out at such processed toothed rim gave the following values for the lower or support or contact surface A and the upper surface B, respectively:

Outer diameter
A $\Delta D=1.8$ mm $D=1717.83$ (mean value)
B $\Delta D=1.2$ mm $D=1717.08$ (mean value)
mean conicicity 0.75 mm
$\Delta D \triangleq$ difference between largest and smallest diameter.

The mean web-inner diameter amounted at the top to 1428.83 mm and at the bottom to 1429.13 mm.

This demonstrates that the shape and dimensional changes following such heat or thermal treatment were appreciable notwithstanding the uniform and slow heating and cooling.

For hardening the toothed rim there was used a support body member of the type disclosed previously with reference to FIGS. 4 and 5.

The carburized toothed rim was heated in an electrically heated chamber oven or furnace to hardening temperature and in so doing was mounted upon a stable support ring, so that the smaller outer diameter B was at the bottom. Since, as explained above, the carburized toothed or gear rim was extremely conical, during hardening the smaller side had to be more intensely enlarged. Therefore, the outer diameter of the support body member was appropriately differently dimensioned, namely for the web-inner diameter of 1429.13 mm the outer diameter of the support body member amounted to 1429.40 mm, and for the web-inner diameter of 1428.83 mm the outer diameter of the support body member amounted to 1429.80 mm.

The hardening temperature was set at 870° C., where the steel of which the toothed rim is formed is in its austenitic condition (see also FIG. 1), whereas the support body member was pre-heated to 330° C. The toothed or gear rim was quenched in an oil bath at a temperature of 60° C. while the support body member was essentially horizontal. After cooling down to room or ambient temperature it was possible to easily remove the support body member out of the toothed or gear rim.

Such was then well cleaned and measured, and the following results were obtained:

Outer diameter
side A: $\Delta D=0.2$ mm, $D=1719.22$ (mean value)
side B: $\Delta D=0.5$ mm, $D=1719.42$ (mean value)
Plan or flatness error=0.21 mm.

The running true or concentricity error was measured at a vertical boring mill at the center of the tooth width and was determined to be 0.12 mm.

While there are shown and described present preferred embodiments of the invention, it is to be distinctly understood that the invention is not limited thereto, but may be otherwise variously embodied and practiced within the scope of the following claims.

Accordingly, what we claim is:

1. A method for the reduction of the distortion on hardening during case hardening of large toothed rims formed of steel, comprising the steps of:

shrinking the carburized toothed rim during cooling, starting from its hardening temperature where the steel is in its austenitic condition, and during the $\gamma/\alpha$-transformation of its core material, onto a substantially disc-like support body member;

further cooling the assembly composed of the toothed rim and the disc-like support body member; and during such further cooling of the assembly of the toothed rim and disc-like support body member down to room temperature limiting the increase of the stress in the toothed rim by means of said disc-like support body member.

2. The method as defined in claim 1, further including the steps of:

inserting a pre-heated disc-like support body member into the toothed rim in order to limit the increase of the stress in the toothed rim; and utilizing a disc-like support body member whose material possesses a greater coefficient of thermal expansion than the coefficient of thermal expansion of the material from which there is formed the toothed rim.

3. The method as defined in claim 2, further including the step of:

preheating said disc-like support body member to a temperature in the range of 330° to 400° C.

4. The method as defined in claim 1, further including the steps of:

arranging deformable parts on the outer side of the disc-like support body member;

inserting said disc-like support body member into said toothed rim; and positioning said deformable parts intermediate said toothed rim and said disc-like support body member.

5. The method as defined in claim 1, further including the step of:

quenching said toothed rim after said disc-like support body member has been inserted thereinto.

6. The method as defined in claim 1, wherein:

there is used as the disc-like support body member a member formed of austenitic steel.

* * * * *

UNITED STATES PATENT AND TRADEMARK OFFICE

CERTIFICATE OF CORRECTION

PATENT NO. : 4,469,530

DATED : September 4, 1984

INVENTOR(S) : Wyss et al

It is certified that error appears in the above—identified patent and that said Letters Patent is hereby corrected as shown below:

Column 1, line 52, after "namely the" please delete "weld" and insert --wheel--.

Column 5, line 15, after "in the" please delete "cae" and insert --case--.

Signed and Sealed this

Twelfth Day of February 1985

[SEAL]

*Attest:*

DONALD J. QUIGG

*Attesting Officer* *Acting Commissioner of Patents and Trademarks*